US010485295B2

(12) United States Patent
Bunnell et al.

(10) Patent No.: US 10,485,295 B2
(45) Date of Patent: Nov. 26, 2019

(54) SOLE STRUCTURE FOR AN ARTICLE OF FOOTWEAR WITH LONGITUDINAL TENSION MEMBER AND NON-LINEAR BENDING STIFFNESS

(71) Applicant: NIKE, Inc., Beaverton, OR (US)

(72) Inventors: Dennis D. Bunnell, Vancouver, WA (US); Summer L. Schneider, Portland, OR (US); Alison Sheets-Singer, Portland, OR (US); Steven H. Walker, Camas, WA (US)

(73) Assignee: NIKE, Inc., Beaverton, OR (US)

( * ) Notice: Subject to any disclaimer, the term of this patent is extended or adjusted under 35 U.S.C. 154(b) by 169 days.

(21) Appl. No.: 15/601,402

(22) Filed: May 22, 2017

(65) Prior Publication Data

US 2017/0340056 A1 Nov. 30, 2017

Related U.S. Application Data

(60) Provisional application No. 62/343,432, filed on May 31, 2016.

(51) Int. Cl.

| | |
|---|---|
| ***A43B 13/18*** | (2006.01) |
| ***A43B 3/06*** | (2006.01) |
| ***A43B 13/12*** | (2006.01) |
| ***A43B 13/14*** | (2006.01) |
| ***A43B 13/16*** | (2006.01) |
| ***A43B 13/28*** | (2006.01) |

(Continued)

(52) U.S. Cl.

CPC ..... *A43B 13/181* (2013.01); *A43B 3/06* (2013.01); *A43B 13/04* (2013.01); *A43B 13/12* (2013.01); *A43B 13/122* (2013.01); *A43B 13/141* (2013.01); *A43B 13/16* (2013.01); *A43B 13/183* (2013.01); *A43B 13/28* (2013.01); *A43B 23/042* (2013.01)

(58) Field of Classification Search

CPC ..... A43B 13/141; A43B 13/18; A43B 13/181; A43B 13/184; A43B 13/186; A43B 13/122; A43B 13/16; A43B 5/0411

USPC ..... 36/102, 103, 107, 25 R, 31

See application file for complete search history.

(56) References Cited

U.S. PATENT DOCUMENTS

| | | | | |
|---|---|---|---|---|
| 634,588 A | | 10/1899 | Roche | |
| 1,964,406 A | * | 6/1934 | Pellkofer | A43B 3/128 36/11.5 |
| 2,072,785 A | | 3/1937 | Wulff | |

(Continued)

FOREIGN PATENT DOCUMENTS

| | | | |
|---|---|---|---|
| DE | 315919 | C | 11/1919 |
| DE | 202007000831 | U1 | 5/2007 |

(Continued)

*Primary Examiner* — Marie D Bays

(74) *Attorney, Agent, or Firm* — Quinn IP Law

(57) ABSTRACT

A sole structure for an article of footwear comprises a sole plate that includes a foot-facing surface with a forefoot portion, and a ground-facing surface opposite from the foot-receiving surface. A tension member is operatively secured to the ground-facing surface and has a portion configured to move relative to the sole plate during dorsiflexion of the sole structure in a first portion of a flexion range, and interfere with the sole plate during dorsiflexion of the sole structure in a second portion of the flexion range greater than the first portion altering the rate of the resultant torque.

23 Claims, 9 Drawing Sheets

(51) Int. Cl.
*A43B 23/04* (2006.01)
*A43B 13/04* (2006.01)

(56) References Cited

U.S. PATENT DOCUMENTS

| | | | | | |
|---|---|---|---|---|---|
| 2,342,188 | A * | 2/1944 | Ghez | A43B 13/08 | 36/141 |
| 2,342,466 | A | 2/1944 | Gordon | | |
| 2,379,139 | A | 6/1945 | Flink | | |
| 2,413,545 | A * | 12/1946 | Cordi | A43B 5/12 | 116/67 R |
| 2,470,200 | A | 5/1949 | Wallach | | |
| 2,478,664 | A * | 8/1949 | Morrow | A43B 3/128 | 36/31 |
| 2,537,123 | A | 1/1951 | Dowling, Sr. | | |
| 2,640,283 | A | 6/1953 | McCord | | |
| 2,922,235 | A | 1/1960 | Meltzer | | |
| 3,039,207 | A * | 6/1962 | Lincors | A43B 13/18 | 36/58.5 |
| 3,782,011 | A | 1/1974 | Fisher | | |
| 4,026,045 | A | 5/1977 | Druss | | |
| 4,255,877 | A | 3/1981 | Bowerman | | |
| 4,391,048 | A | 7/1983 | Lutz | | |
| 4,476,638 | A | 10/1984 | Quacquarini et al. | | |
| 4,573,457 | A | 3/1986 | Parks | | |
| 4,779,361 | A | 10/1988 | Kinsaul | | |
| 4,839,972 | A * | 6/1989 | Pack | A43B 5/0472 | 36/114 |
| 4,920,665 | A * | 5/1990 | Pack | A43B 5/0474 | 280/613 |
| 4,936,028 | A | 6/1990 | Posacki | | |
| 4,941,273 | A | 7/1990 | Gross | | |
| 5,243,776 | A | 9/1993 | Zelinko | | |
| 5,392,537 | A * | 2/1995 | Goldberg | A43B 3/0042 | 36/115 |
| 5,461,800 | A | 10/1995 | Luthi et al. | | |
| 5,572,806 | A * | 11/1996 | Osawa | A43B 5/0472 | 36/103 |
| 5,729,912 | A | 3/1998 | Gutkowski et al. | | |
| 6,092,309 | A | 7/2000 | Edwards | | |
| 6,125,556 | A | 10/2000 | Peckler et al. | | |
| 6,202,326 | B1 | 3/2001 | Hauglin | | |
| 6,237,255 | B1 * | 5/2001 | Renaudin | A43B 3/26 | 36/102 |
| 7,100,308 | B2 | 9/2006 | Aveni | | |
| 7,143,530 | B2 | 12/2006 | Hudson et al. | | |
| 7,401,422 | B1 | 7/2008 | Scholz et al. | | |
| 7,513,065 | B2 | 4/2009 | Kita et al. | | |
| 8,117,770 | B2 * | 2/2012 | Wong | A43B 7/14 | 36/114 |
| 8,578,629 | B2 * | 11/2013 | Bosomworth | A43B 13/10 | 36/102 |
| 8,646,191 | B2 * | 2/2014 | Amos | A43B 7/1425 | 36/103 |
| 9,179,733 | B2 | 11/2015 | Peyton et al. | | |
| 9,968,160 | B2 | 5/2018 | Peyton | | |
| 10,226,097 | B2 * | 3/2019 | Farris | A43B 13/04 | |
| 2001/0007177 | A1 | 7/2001 | Brown, Jr. et al. | | |
| 2005/0000115 | A1 | 1/2005 | Kimura et al. | | |
| 2005/0039350 | A1 | 2/2005 | Hung | | |
| 2006/0117600 | A1 | 6/2006 | Greene | | |
| 2006/0254087 | A1 | 11/2006 | Fechter | | |
| 2007/0039208 | A1 | 2/2007 | Bove et al. | | |
| 2008/0066348 | A1 | 3/2008 | O'Brien et al. | | |
| 2008/0263900 | A1 * | 10/2008 | Determe | A43B 7/1465 | 36/107 |
| 2010/0139122 | A1 | 6/2010 | Zanatta | | |
| 2010/0218397 | A1 | 9/2010 | Nishiwaki et al. | | |
| 2011/0047816 | A1 | 3/2011 | Nurse | | |
| 2011/0214313 | A1 | 9/2011 | James et al. | | |
| 2012/0036739 | A1 * | 2/2012 | Amos | A43B 7/1425 | 36/103 |
| 2012/0055047 | A1 | 3/2012 | Youngs | | |
| 2013/0326911 | A1 | 12/2013 | Baucom et al. | | |
| 2014/0182167 | A1 | 7/2014 | James et al. | | |
| 2014/0223778 | A1 * | 8/2014 | Horacek | A43B 3/0036 | 36/102 |
| 2014/0250723 | A1 | 9/2014 | Kohatsu | | |
| 2014/0366401 | A1 * | 12/2014 | Cavaliere | A43B 13/14 | 36/103 |
| 2015/0027005 | A1 | 1/2015 | Lee et al. | | |
| 2015/0047222 | A1 | 2/2015 | Rushbrook | | |
| 2015/0089841 | A1 | 4/2015 | Smaldone et al. | | |
| 2015/0282557 | A1 | 10/2015 | Kirk et al. | | |
| 2017/0079374 | A1 * | 3/2017 | Farris | A43B 13/04 | |
| 2017/0079375 | A1 | 3/2017 | Bunnell et al. | | |
| 2017/0079376 | A1 | 3/2017 | Bunnell et al. | | |
| 2017/0079378 | A1 | 3/2017 | Farris et al. | | |
| 2017/0127755 | A1 | 5/2017 | Bunnell et al. | | |
| 2017/0340055 | A1 | 11/2017 | Schneider | | |
| 2017/0340056 | A1 * | 11/2017 | Bunnell | A43B 3/06 | |
| 2017/0354200 | A1 | 12/2017 | Orand et al. | | |
| 2017/0367439 | A1 | 12/2017 | Fallon | | |
| 2018/0027922 | A1 | 2/2018 | Orand | | |
| 2018/0042338 | A1 | 2/2018 | Orand | | |

FOREIGN PATENT DOCUMENTS

| | | | |
|---|---|---|---|
| DE | 102012104264 | A1 | 11/2013 |
| EP | 1127504 | A2 | 8/2001 |
| EP | 1483981 | A1 | 12/2004 |
| EP | 2926678 | A2 | 10/2015 |
| FR | 892219 | A | 3/1944 |
| FR | 2974482 | A1 | 11/2012 |
| WO | 03075698 | A1 | 9/2003 |
| WO | 2006087737 | A1 | 8/2006 |
| WO | 2011005728 | A1 | 1/2011 |

* cited by examiner

SOLE STRUCTURE FOR AN ARTICLE OF FOOTWEAR WITH LONGITUDINAL TENSION MEMBER AND NON-LINEAR BENDING STIFFNESS

CROSS REFERENCE TO RELATED APPLICATION

This application claims the benefit of priority to U.S. Provisional Application Ser. No. 62/343,432 filed May 31, 2016, which is incorporated by reference in its entirety.

TECHNICAL FIELD

The present teachings generally include a sole structure for an article of footwear.

BACKGROUND

Footwear typically includes a sole structure configured to be located under a wearer's foot to space the foot away from the ground. Sole assemblies in athletic footwear are configured to provide desired cushioning, motion control, and resiliency.

DESCRIPTION

Figure 1:
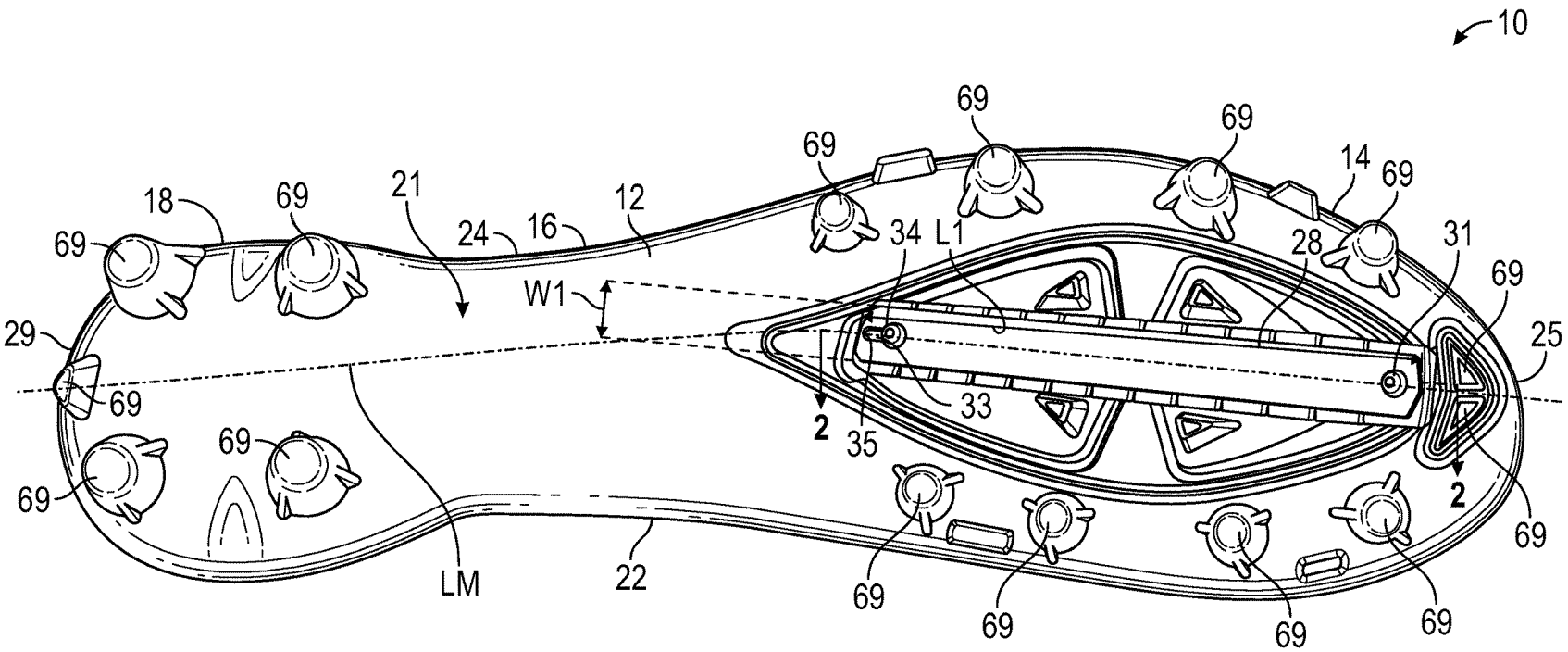
FIG. 1 is a schematic illustration in perspective view of a ground-facing surface of an embodiment of a sole structure for an article of footwear in an unflexed position.

A sole structure for an article of footwear comprises a sole plate that includes a forefoot portion with a foot-facing surface and a ground-facing surface opposite from the foot-facing surface. The sole plate may be a unisole plate, an inner board plate, an outsole plate, a midsole plate, or any combination of an inner board plate, an outsole plate, and a midsole plate. The sole structure further comprises a tension member operatively secured to the ground-facing surface and having a portion configured to move relative to the sole plate during dorsiflexion of the sole structure in a first portion of a flexion range, and interfere with the sole plate during dorsiflexion of the sole structure in a second portion of the flexion range greater than the first portion.

In an embodiment, the first portion of the flexion range includes flex angles of the sole plate less than a first predetermined flex angle, and the second portion of the sole plate includes flex angles greater than or equal to the first predetermined flex angle. Due to the tension member interfering with the sole plate in the second portion of the flexion range, the sole structure has a change in bending stiffness at the first predetermined flex angle. For example, the sole structure may provide a first bending stiffness in the first portion of the flexion range, and a second bending stiffness greater than the first bending stiffness in the second portion of the flexion range.

In an embodiment, the tension member is configured to be relatively slack when the portion of the tension member moves relative to the sole plate in the first portion of a flexion range and in tension when the sole plate interferes with the portion in the second portion of the flexion range.

In an embodiment, the portion of the tension member is displaced from the ground-facing surface of the sole plate by a vertical gap in the first portion of the flexion range and is in contact the ground-facing surface in the second portion of the flexion range. For example, the tension member may be fixed to the ground-facing surface of the sole plate at a first location and at a second location spaced apart from the first location during both the first portion of the flexion range and the second portion of the flexion range, and a midportion of the tension member may extend between the first location and the second location in suspension from the sole plate.

In an embodiment, only a forward portion of the tension member is fixed to the sole plate, and the portion that moves relative to the sole plate in the first portion of the flexion range is a rearward portion of the tension member. For example, the portion of the tension member may have a slot, and a post may extend at the ground-facing surface of the sole plate so that it is disposed in the slot. In such an embodiment, the slot moves relative to the plate during the first portion of the flexion range and the post abuts the tension member at an end of the slot in the second portion of the flexion range.

In an embodiment, the sole structure includes at least one protrusion at the ground-facing surface, and the tension member extends across the at least one protrusion such that at least a portion of the tension member is displaced from the foot-facing surface by at least a portion of the protrusion. There is at least one protrusion, or it may be a series of protrusions with gaps between the adjacencies of the protrusions, and the protrusions may vary in height so that the series of protrusions has a bowed profile. In an embodiment, the tension member confronts distal ends of the protrusions and slides along the distal ends during the first portion of the flexion range. The foot-facing surface may have recesses corresponding with the protrusions.

In an embodiment, the tension member is a relatively flat strap having a thickness, a width greater than the thickness, and a length greater than the width. The tension member is disposed lengthwise along a longitudinal midline of the sole plate. The strap may be any one of a variety of materials, including metal, a polymeric material, a composite, or fabric.

In an embodiment, the sole structure comprises at least one protrusion at the ground-facing surface. The at least one protrusion has an enclosed channel. The tension member is disposed in the channel. The channel may be generally U-shaped, with a midportion of the tension member restrained at a first location by the protrusion, and first and second end portions of the tension member both extending in a common direction from midportion.

In an embodiment, an enclosure at the ground-facing surface at least partially encloses the tension member. The enclosure may be at least partially transparent or translucent to enable viewing of the tension member through the enclosure.

The above features and advantages and other features and advantages of the present teachings are readily apparent from the following detailed description of the modes for carrying out the present teachings when taken in connection with the accompanying drawings.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively relative to the figures, and do not represent limitations on the scope of the invention, as defined by the claims.

Figure 2:
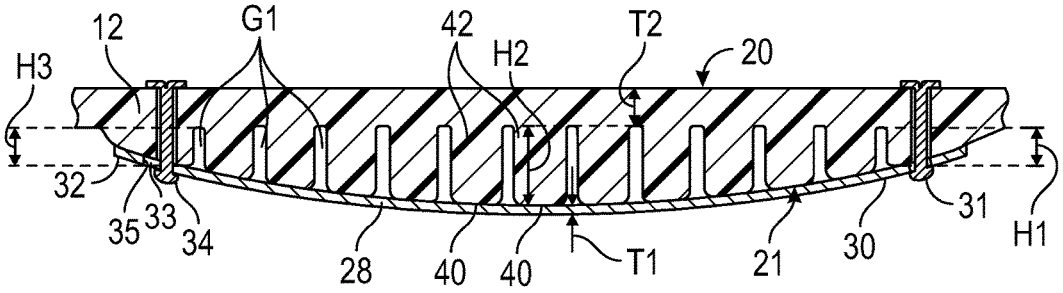
FIG. 2 is a schematic cross-sectional fragmentary view of the sole structure of FIG. 1 taken at lines 2-2 in FIG. 1.

Referring to the drawings, wherein like reference numbers refer to like components throughout the views, FIG. 1 shows a sole structure 10 for an article of footwear 11 shown in FIG. 2. The sole structure 10 has a resistance to flexion that increases with increasing dorsiflexion of the forefoot portion 14 of the sole structure 10 (i.e., flexing of the forefoot portion 14 in a longitudinal direction as discussed herein). As further explained herein, due to a tension member 28 operatively connected to a ground-facing surface 21 of a sole plate 12, the sole structure 10 provides an increase in bending stiffness when flexed in a longitudinal direction. More particularly, the sole structure 10 has a bending stiffness that is a piecewise function with a change at a first predetermined flex angle. The bending stiffness is tuned by the selection of various structural parameters discussed herein that determine the first predetermined flex angle. As used herein, "bending stiffness" may be used interchangeably with "bend stiffness".

Figure 3:
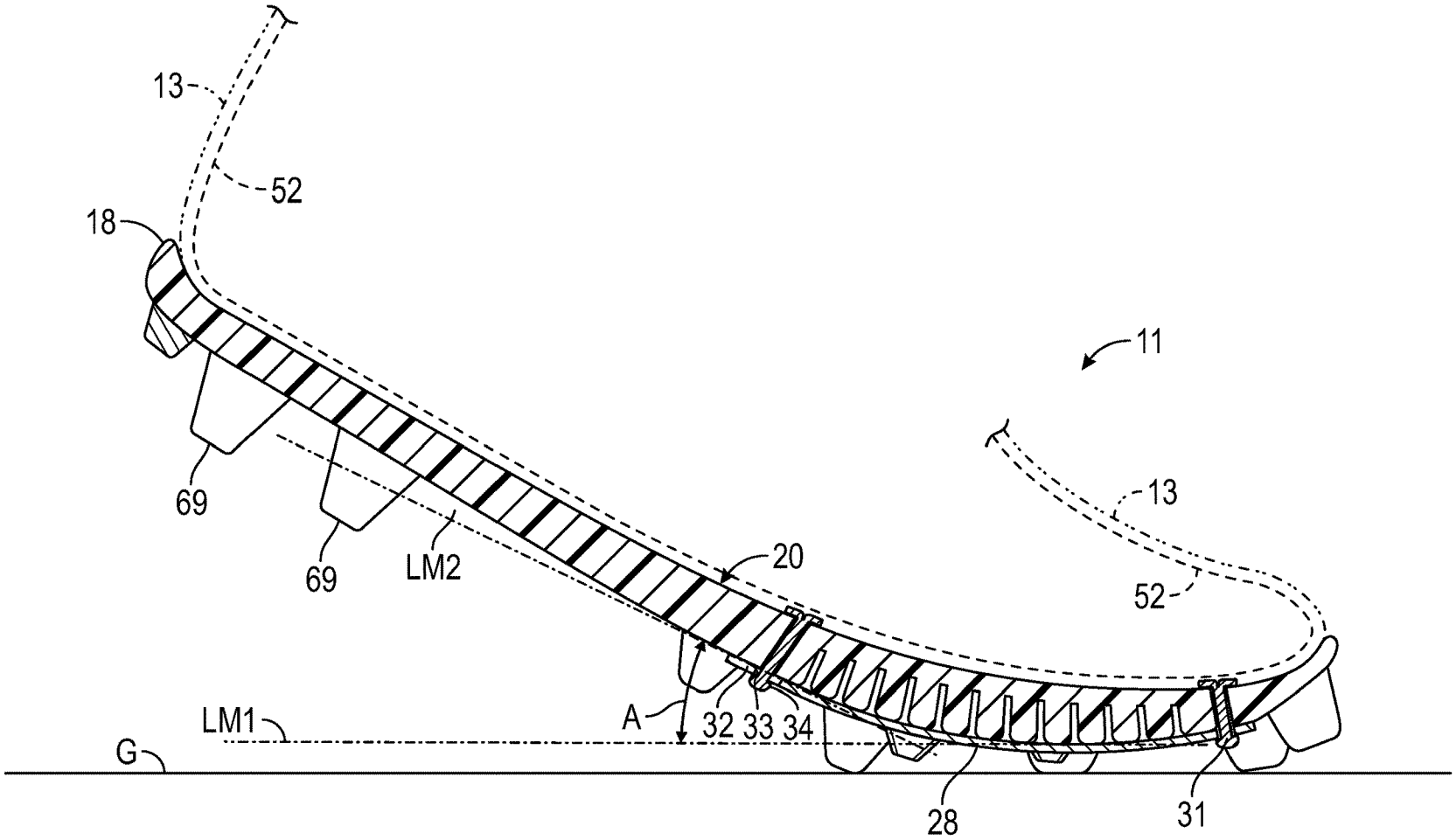
FIG. 3 is a schematic cross-sectional illustration of the sole structure of FIG. 1, taken at a longitudinal midline in FIG. 1, flexed in a first portion of a flexion range.

Referring to FIGS. 1-3, the sole structure 10 includes the sole plate 12, and may include one or more additional plates, layers, or components, as discussed herein. The article of footwear 11 includes an upper 13 (shown in phantom in FIG. 3). The sole plate 12 is configured to be operatively connected to the upper 13 as discussed herein. The upper 13 may incorporate a plurality of material elements (e.g., textiles, foam, leather, and synthetic leather) that are stitched or adhesively bonded together to form an interior void for securely and comfortably receiving a foot 52 as shown. The material elements may be selected and located with respect to the upper 13 in order to selectively impart properties of durability, air-permeability, wear-resistance, flexibility, and comfort, for example. An ankle opening provides access to the interior void. In addition, the upper 13 may include a lace or other tightening mechanism that is utilized to modify the dimensions of the interior void, thereby securing the foot 52 within the interior void and facilitating entry and removal of the foot 52 from the interior void. For example, a lace may extend through apertures in upper 13, and a tongue portion of the upper 13 may extend between the interior void and the lace. The upper 13 may exhibit the general configuration discussed above or a different configuration. Accordingly, the structure of the upper 13 may vary significantly within the scope of the present teachings.

Sole structure 10, includes the sole plate 12, the tension member 28, and, in some embodiments includes other layers and components. The sole structure 10 is secured to the upper 13 and has a configuration that extends between the upper 13 and the ground G (included in FIG. 3). The sole plate 12 may or may not be directly secured to the upper 13. In addition to attenuating ground reaction forces (i.e., providing cushioning for the foot 52), sole structure 10 may provide traction, impart stability, and limit various foot motions.

In the embodiment shown, the sole plate 12 is a full-length, unitary sole plate 12 that has a forefoot portion 14, a midfoot portion 16, and a heel portion 18. The sole plate 12 provides a foot-receiving surface 20 (also referred to as a foot-facing surface) that extends over the forefoot portion 14, the midfoot portion 16, and the heel portion 18. The foot-facing surface 20 supports the foot 52 but need not be in contact with the foot 52. For example, an insole, midsole, strobel, or other layers or components may be positioned between the foot 52 and the foot-facing surface 20.

The sole plate 12 extends from a medial side 22 to a lateral side 24. In other embodiments, the sole plate 12 may be a partial length plate member. For example, in some cases, the sole plate 12 may include only a forefoot portion that may be operatively connected to other components of the article of footwear that comprise a midfoot portion and a heel portion. As shown, the sole plate 12 extends from the lateral side 22 to the medial side 24. As used herein, a lateral side of a component for an article of footwear, including the lateral side 22 of the sole plate 12, is a side that corresponds with an outside area of the human foot 52 (i.e., the side closer to the fifth toe of the wearer). The fifth toe is commonly referred to as the little toe. A medial side of a component for an article of footwear, including the medial side 24 of the sole plate 12, is the side that corresponds with an inside area of the human foot 52 (i.e., the side closer to the hallux of the foot of the wearer). The hallux is commonly referred to as the big toe. Both the lateral side 22 and the medial side 24 extend from a foremost extent 25 to a rearmost extent 29 of a periphery of the sole plate 12.

The term "longitudinal," as used herein, refers to a direction extending along a length of the sole structure 10, e.g., extending from the forefoot portion 14 to the heel portion 18 of the sole structure 10. The term "forward" is used to refer to the general direction from the heel portion 18 toward the forefoot portion 14, and the term "rearward" is used to refer to the opposite direction, i.e., the direction from the forefoot portion 14 toward the heel portion 18. The term "anterior" is used to refer to a front or forward component or portion of a component. The term "posterior" is used to refer to a rear or rearward component or portion of a component.

The heel portion 18 generally includes portions of the sole plate 12 corresponding with rear portions of a human foot, including the calcaneus bone, when the human foot is supported on the sole structure 10 and is a size corresponding with the sole structure 10. The forefoot portion 14 generally includes portions of the sole plate 12 corresponding with the toes and the joints connecting the metatarsal bones with the phalange bones of the human foot (interchangeably referred to herein as the "metatarsal-phalangeal joints" or "MPJ" joints). The midfoot portion 16 generally includes portions of the sole plate 12 corresponding with an arch area of the human foot, including the navicular joint. Portions 14, 16, 18 are not intended to demarcate precise areas of the sole structure 10. Rather, portions 14, 16, 18 are intended to represent general areas relative to one another, to aid in the following discussion. In addition to the sole structure 10, the portions 14, 16, 18, and medial and lateral sides 22, 24 may also be applied to the upper 13, the article of footwear 11, and individual components thereof.

The sole plate 12 is referred to as a plate, but is not necessarily flat and need not be a single component but instead can be multiple interconnected components. For example, both an upward-facing portion of the foot-facing surface 20 and the opposite ground-facing surface 21 may be pre-formed with some amount of curvature and variations in thickness when molded or otherwise formed in order to provide a shaped footbed and/or increased thickness for reinforcement in desired areas. For example, the sole plate 12 could have a curved or contoured geometry that may be similar to the lower contours of the foot 52. For example, the sole plate 12 may have a contoured periphery that slopes upward toward any overlaying layers, such as a midsole component or the upper 13.

The sole plate 12 may be entirely of a single, uniform material, or may have different portions comprising different materials. For example, a first material of the forefoot portion 14 can be selected to achieve, in conjunction with the tension member 28 and other features and components of the sole structure 12 discussed herein, the desired bending stiffness in the forefoot portion 14, while a second material of the midfoot portion 16 and the heel portion 18 can be a different material that has little effect on the bending stiffness of the forefoot portion 14. By way of non-limiting example, the second portion can be over-molded onto or co-injection molded with the first portion. Example materials for the sole plate 12 include durable, wear resistant materials such as but not limited to nylon, thermoplastic polyurethane, or carbon fiber.

In the embodiment shown, the sole plate 12 may be an inner board plate, also referred to as an inner board, an insole board, or a lasting board. In other embodiments, the sole plate 12 may be an outsole. Still further, the sole plate 12 could be a midsole plate or a unisole plate, or may be any combination of an inner board plate, a midsole plate, or an outsole.

The tension member 28 is operatively secured to the ground-facing surface 21 of the sole plate 12. As used herein, a tension member is "operatively secured" to a sole plate when the tension member is directly or indirectly attached to the sole plate 12. In the embodiment of FIGS. 1-4, the tension member 28 is a relatively flat strap having a thickness T1 (shown in FIG. 2), a width W1 (shown in FIG. 1) greater than the thickness, and a length L1 greater than the width. The tension member 28 is disposed lengthwise along a longitudinal midline of the sole plate 12. The tension member 28 may be a variety of materials including metal, a polymeric material, a composite, or fabric.

In the embodiment shown in FIGS. 1-4, the tension member 28 has a portion 32 configured to move relative to the sole plate 12 during dorsiflexion of the sole structure 10 in a first portion of a flexion range FR1, and interfere with the sole plate 12 during dorsiflexion of the sole structure 10 in a second portion of the flexion range FR2 greater than the first portion. In the embodiment shown, the tension member 28 has a forward portion 30 fixed to the sole plate 12. As shown, the forward portion 30 is fixed to the sole plate 12 by a fastener or by an integral extension of the sole plate 12. In the embodiment shown, for purposes of illustration, the fastener is a rivet 31. The forward portion 30 may instead be secured to the sole plate 12 by thermal bonding, adhesive, other fasteners, or may be integrally formed with the sole plate 12.

In the embodiment shown, the forward portion 30 is the only portion of the tension member 28 fixed to the sole plate 12 during the entire flexion range of the sole structure 10. Those portions of the tension member 28 rearward of the forward portion 30, including the rear portion 32 that includes a slot 33, are configured to move relative to the sole plate 12 during a first portion of a flexion range FR1. The rearward portion 32 interferes with the sole plate 12 during dorsiflexion of the sole structure 10 in the second portion of a flexion range FR2. More specifically, with reference to FIG. 2, a post 34 extends at the ground-facing surface 21 of the sole plate 12 and is disposed in the slot 33. In the embodiment shown, the post 34 is depicted as a rivet, but may be any type of fastener or may be an integral extension of the sole plate 12. During the first portion of the flexion range FR1, the slot 33 moves forward with the rearward portion 32 of the tension member 28 relative to the plate 12 and the post 34 remains out of contact with the rear end 35 of the slot 33 (shown in FIG. 3).

With reference to FIG. 2, the sole plate 12 includes protrusions 42 at the ground-facing surface 21. The protrusions 42 are arranged in a series with gaps G1 between adjacent ones of the protrusions 42. Some of the gaps G1 and some of the protrusions 42 are indicated with reference numbers in FIG. 2. When the sole structure 10 is flexed at progressively increasing flex angles, the tension member 28 slides along the distal ends 40 of the protrusions 42, as described, during the first portion FR1 of the flexion range.

The tension member 28 and the sole plate 12 including the protrusions 42 are configured so that, in the first portion of the flexion range FR1, the tension member 28 is in contact with and slides along the bottom facing surface 21 at the distal ends 40 of protrusions 42. This sliding action, in addition to the natural widening of the gaps G1 with increasing flex angle, could have the beneficial effect of dislodging debris that may have become lodged in the gaps G1 or between the tension member 28 and the distal ends 40. The gaps G1 are able to widen at least during the first portion of the flexion range FR1. In some embodiments, an enclosure similar to that described with respect to FIGS. 6 and 7 may be used to cover the tension member 28 and protrusions 42 to prevent debris from contacting the tension member 28 or entering the gaps G1.

The resistance to flexion and the bending stiffness of the sole structure 10 in the first portion of the flexion range FR1 is influenced by the thickness T2 of the sole plate 12 above the protrusions 42, but not significantly by the height of the protrusions 42 as the protrusions 42 move apart from one another unrestrained by the tension member 28 in the first portion of the flexion range FR1, such as when flexed at angle A shown in FIG. 3.

At a first predetermined flex angle A1, which is the beginning of a second portion of the flexion range FR2, the post 34 abuts the tension member 28 at an end 35 of the slot 33 (shown in FIG. 4), and thereafter remains in abutment with the tension member at the end 35 at progressively increasing flex angles in the second portion of the flexion range FR2. By abutting the tension member 28, the post 34 stops further sliding of the tension member 28 relative to the sole plate 12 at the rear portion 32 of the tension member 28. The tension member 28 may have a length such that, with both the front portion 30 and the rear portion 32 now substantially stationary relative to the sole plate 12, further dorsiflexion of the sole structure 10 places the tension member 28 under increased tension, causing a corresponding increase in resistance to flexion and bending stiffness of the sole structure 10. In addition, the protrusions 42 displace the tension member 28 further from the foot-facing surface 20 than if the sole plate 12 had no protrusions 42 (i.e., if the ground-facing surface was relatively flat). The greater displacement of the tension member 28 from the foot-facing surface 20 increases the tension placed on the tension member 28 at a given flex angle, as will be understood by those skilled in the art.

Figure 4:
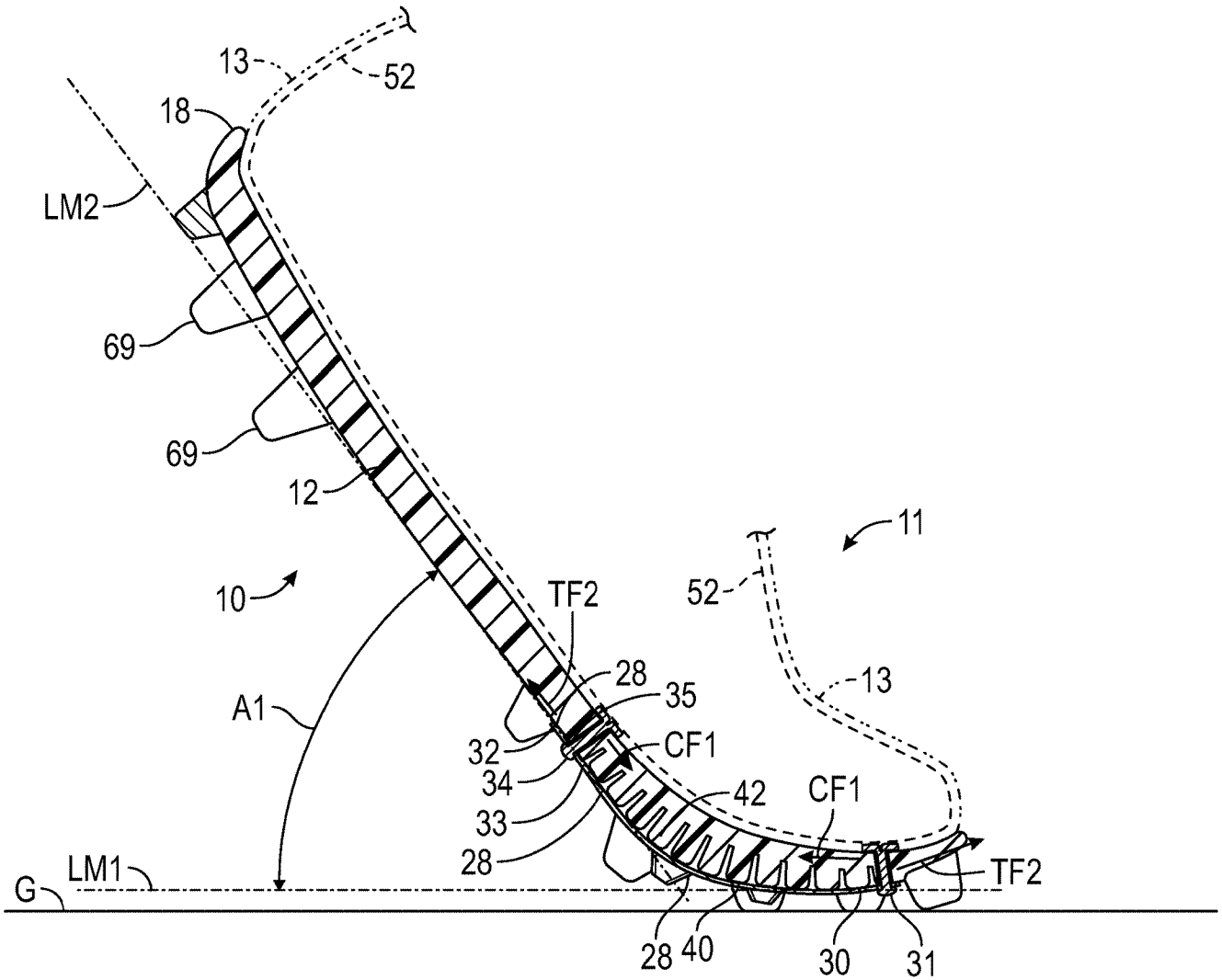
FIG. 4 is a schematic cross-sectional illustration of the sole structure of FIG. 3 flexed at a first predetermined flex angle.

With reference to FIG. 4, the first predetermined flex angle A1 is defined as the angle formed at the intersection between a first axis LM1 and a second axis LM2 (best shown in FIG. 4) where the first axis LM1 generally extends along a longitudinal midline LM at the ground-facing surface 21 of sole plate 12 (best shown in FIG. 1) anterior to the tension member 28, and the second axis LM2 generally extends along the longitudinal midline LM at the ground-facing surface 21 of the sole plate 12 posterior to the tension member 28. The sole plate 12 is configured so that the intersection of the first and second axes LM1 and LM2 will typically be approximately centered both longitudinally and transversely below the tension member 28 discussed herein, and below the metatarsal-phalangeal joints of the foot 52 supported on the foot-facing surface 20. By way of non-limiting example, the first predetermined flex angle A1 may be from about 30 degrees to about 65 degrees. In one exemplary embodiment, the first predetermined flex angle A1 is found in the range of between about 30 degrees and about 60 degrees, with a typical value of about 55 degrees. In another exemplary embodiment, the first predetermined flex angle A1 is found in the range of between about 15 degrees and about 30 degrees, with a typical value of about 25 degrees. In another example, the first predetermined flex angle A1 is found in the range of between about 20 degrees and about 40 degrees, with a typical value of about 30 degrees.

The sole structure 10 will bend in dorsiflexion in response to forces applied by corresponding bending of a user's foot at the MPJ during physical activity. Throughout the first portion of the flexion range FR1, bending stiffness (defined as the change in moment as a function of the change in angle) will remain approximately the same as bending progresses through increasing angles of flexion. Because bending within the first portion of the flexion range FR1 is primarily governed by inherent material properties of the materials of the sole plate 12, a graph of torque on the plate versus angle of flexion (the slope of which is the bending stiffness) in the first portion of the flexion range FR1 will typically demonstrate a smoothly but relatively gradually inclining curve (referred to herein as a "linear" region with constant bending stiffness). In the first portion of the flexion range FR1, the tension member 28 is under no tension, or under only minimal tension such as due to friction with the distal ends 40, in the first portion of the flexion range FR1. At the boundary between the first and second portions of the range of flexion FR1 and FR2, however, the abutment of the post 34 with the tension member 28 at the end 35 of the slot 33 engages additional material and mechanical properties that exert a notable increase in resistance to further dorsiflexion (i.e., the tension member 28 is placed under markedly increased tension, and the sole plate 12 is placed under compression by the tension member 28).

Figure 5:
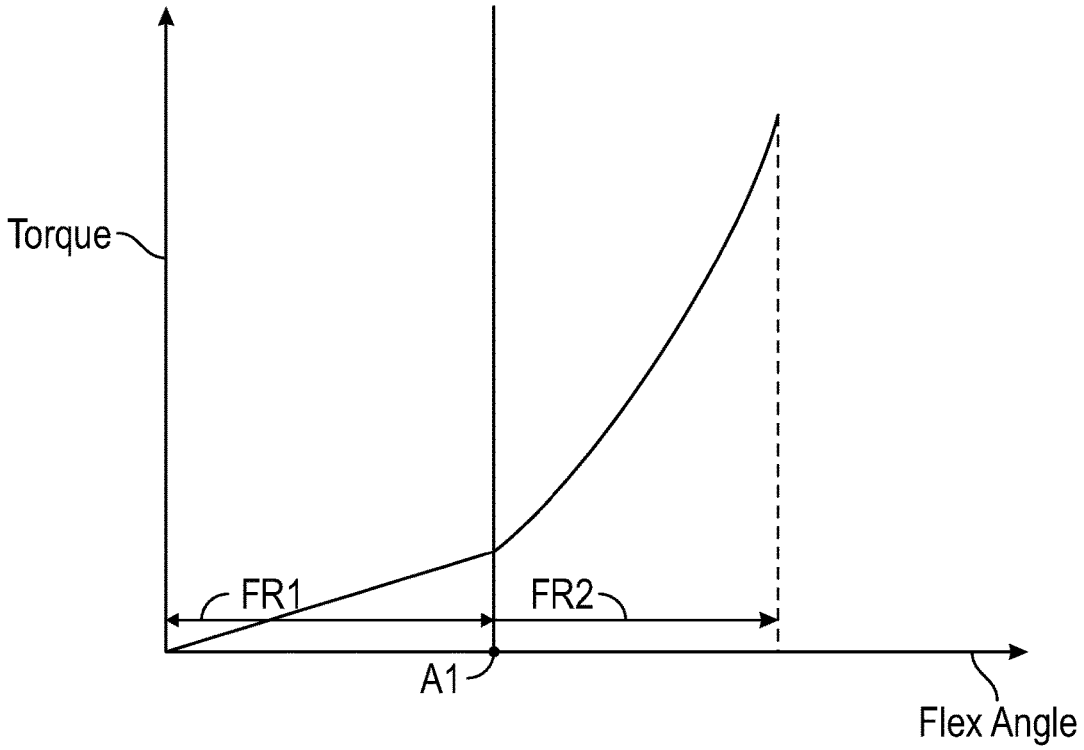
FIG. 5 is a plot of torque versus flex angle for the sole structure of FIGS. 1-4.

Therefore, a corresponding graph of torque versus angle of deflection (the slope of which is the bending stiffness) that also includes the second portion of the flexion range FR2 would show—beginning at an angle of flexion approximately corresponding to angle A1—a departure from the gradually and smoothly inclining curve characteristic of the first portion of the flexion range FR1. This departure is referred to herein as a "non-linear" increase in bend stiffness, and would manifest as either or both of a stepwise increase in bending stiffness and/or a change in the rate of increase in the bending stiffness. The change in rate can be either abrupt, or it can manifest over a short range of increase in the bend angle of the sole structure 10. In either case, a mathematical function describing a bending stiffness in the second portion of the flexion range FR2 will differ from a mathematical function describing bending stiffness in the first portion of the flexion range. FIG. 5 is an example plot depicting an expected increase in resistance to flexion at increasing flex angles, as exhibited by the increasing magnitude of torque required at the heel portion 18 for dorsiflexion of the forefoot portion 14. The bending stiffness in the first range of flexion FR1 may be constant (thus the plot would have a linear slope) or substantially linear or may increase gradually (which would show a change in slope in FR1). The bending stiffness in the second range of flexion FR2 may be linear or non-linear, but will depart from the bending stiffness of the first range of flexion FR1 at the first predetermined flex angle A1, either markedly or gradually (such as over a range of several degrees) at the first predetermined flex angle A1 due to the abutment of the post 34 with the tension member 28 at the end 35 of the slot 33.

Functionally, when the sole plate 12 is dorsiflexed in the first portion of the flexion range FR1, as shown in FIG. 3, the tension member 28 simply slides along the adjacent facing surface of the sole plate 12. During this first portion of the flexion range FR1, the sole plate 12 bends freely and relatively unconstrained by the tension member 28, and the tension member is relatively slack. When the flex angle of the sole structure 10 reaches the first predetermined flex angle A1, longitudinally opposing compressive forces directed inwardly upon the sole plate 12 can no longer be relieved by the sole plate 12 bending outwardly toward the tension member 28 without placing the tension member 28 under tension, as they would throughout the first portion of the flexion range FR1. Instead, further bending of the sole 12 plate is additionally constrained by the tension member's 28 resistance to elongation in response to the progressively increasing tensile forces applied along its long axis, and by the sole plate's 12 resistance to compressive shortening and deformation in response to the compressive forces applied along its longitudinal axis. Accordingly, the tensile and compressive characteristics of the material(s) of the tension member 28 and sole plate 12, respectively, play a large role in determining a change in bending stiffness of the sole structure 10 as it transitions from the first portion of the flexion range FR1, to and through the second portion of the flexion range FR2.

With reference to FIGS. 3-5, as the foot 52 flexes by lifting the heel portion 18 away from the ground G while maintaining contact with the ground G at a forward portion of the article of footwear 11 corresponding with a forward portion of the forefoot portion 14, it places torque on the sole structure 10 and causes the sole plate 12 to flex at the forefoot portion 14.

As will be understood by those skilled in the art, during bending of the sole plate 12 as the foot 52 is dorsiflexed, there is a layer in the sole plate 12 referred to as a neutral plane (although not necessarily planar) or a neutral axis above which the sole plate 12 is in compression, and below which the sole plate 12 is in tension. The interference of the tension member 28 with the post 34 while abutting the distal end 40 places the tension member 28 in tension and causes additional compressive forces CF1 on the sole plate 12 above the neutral plane, and additional tensile forces TF2 below the neutral plane, nearer the ground-facing surface 21.

In addition to the mechanical (e.g., tensile, compression, etc.) properties of the selected material of the sole plate 12 and the tension member 28, structural factors that likewise affect changes in bend stiffness during dorsiflexion include but are not limited to the thicknesses, the longitudinal lengths, and the medial-lateral widths of the sole plate 12, including the protrusions 42, and the tension member 28.

Traction elements 69 are shown in FIGS. 1, 3, and 4. The traction elements 69 may be integrally formed as part of the sole plate 12 (e.g., if the sole plate is an outsole or a unisole plate), may be attached to the sole plate 12, or may be formed with or attached to another plate underlying the sole plate 12, such as if the sole plate 12 is an inner board plate and the sole structure 10 includes an underlying outsole. For example, the traction elements 69 may be integrally formed cleats. In other embodiments, the traction elements may be, for example, removable spikes. The traction elements 69 protrude below the ground-facing surface 21 of the sole plate 12. Direct ground reaction forces on the sole plate 12 that could affect operation of the tension member 28 are thus minimized. In other embodiments, however, the sole structure 10 may have no traction elements 69, the ground-facing surface 21 may be the ground-contact surface, or other plates or components may underlie the sole plate 12.

Referring again to FIG. 2, there are two end protrusions 42. One of the end protrusions 42 secures the rivet 31, and the other end protrusion 42 secures the post 34. There are eleven additional protrusions 42 between the end protrusions 42 in the embodiment shown. The protrusions 42 are of varying heights, with the heights ascending from the forward most protrusion to the middle protrusions, and then descending from the middle protrusions to a rearmost protrusion. The heights are measured, for purposes of illustration in FIG. 2, from the sole plate 12 at the depth of the gaps G1 between the protrusions 42. The forward most protrusion 42 has a greatest height H1. The middle protrusion 42 has a greatest height H2. The rearmost protrusion 42 has a greatest height H3. The protrusions 42 between the forward most protrusion 42 and the middle protrusion 42 ascend in height in order, and the protrusions from the middle protrusion 42 to the rearmost protrusion 42 descend in height in order. Accordingly, the series of protrusions 42 together establish a bowed profile even when the sole plate 12 is in the unflexed, relaxed state of FIG. 2. The tension member 28 may also be preformed with a bowed profile that corresponds to the bowed profile of the protrusions 42 in the relaxed state of the sole plate 12.

In other embodiments, the protrusions 42 could instead be a single, solid protrusion having the bowed profile provided by the series of protrusions 42. Additionally, in an embodiment, instead of confronting the distal end 40 of each protrusion 42, each of the protrusions 42 could have an aperture, and the apertures could be aligned so that the tension member 28 could extend through the apertures and rest against a surface of each protrusion 42 with the aperture nearest the foot-facing surface 20 (i.e., an upper surface of the aperture).

Figure 6:
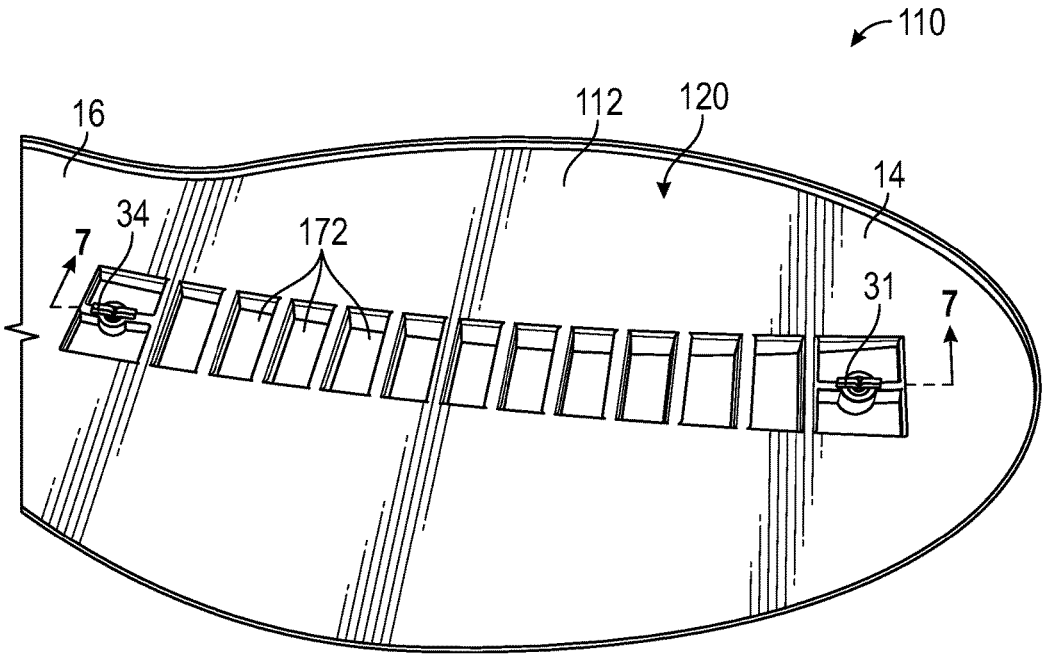
FIG. 6 is a schematic illustration in perspective view showing a foot-facing surface of an alternative embodiment of a sole plate within the scope of the present teachings.
Figure 7:
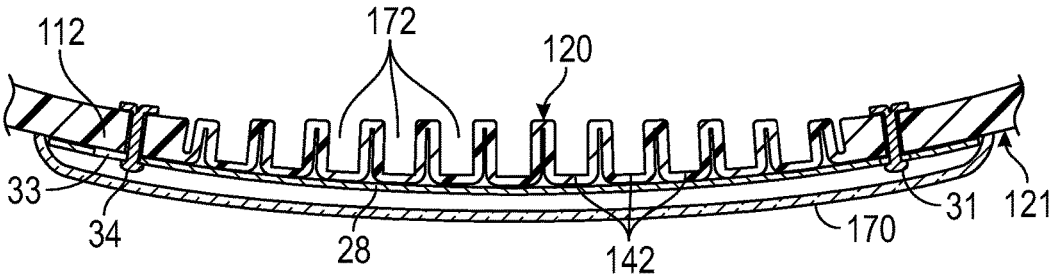
FIG. 7 is a schematic cross-sectional fragmentary view of a sole structure with the sole plate of FIG. 6 taken at lines 7-7 in FIG. 6.

In another embodiment, a cover or enclosure that may be integral with or separate from the sole plate 12 can enclose the tension member 28 and the gaps G1. For example, FIGS. 6 and 7 show an embodiment of a sole structure 110 that has many of the same components that function in the same manner as described with respect to sole structure 10. Such components are referred to with like reference numbers.

The sole structure 110 includes a sole plate 112 with an enclosure 170 at the ground-facing surface 121 that encloses the tension member 28. The enclosure 170 protects the tension member 28 from reacting against an uneven ground surface, and from contamination with debris. The enclosure 170 may be transparent or translucent, or have at least a portion that is transparent or translucent, in order to enable viewing of the tension member 28 through the enclosure 170.

The sole plate 112 has recesses 172 at the foot-facing surface 120 that correspond with protrusions 142 at the ground-facing surface 121. The protrusions 142 are thus relatively thin-walled in comparison to the solid protrusions 42 indicated by the cross-sectional view of FIG. 2. Otherwise, the protrusions 142 have the same bowed profile of the protrusions 42, and displace the tension member 28 further from the foot-facing surface 120 than if the sole plate 112 had no protrusions 142

Figure 8:
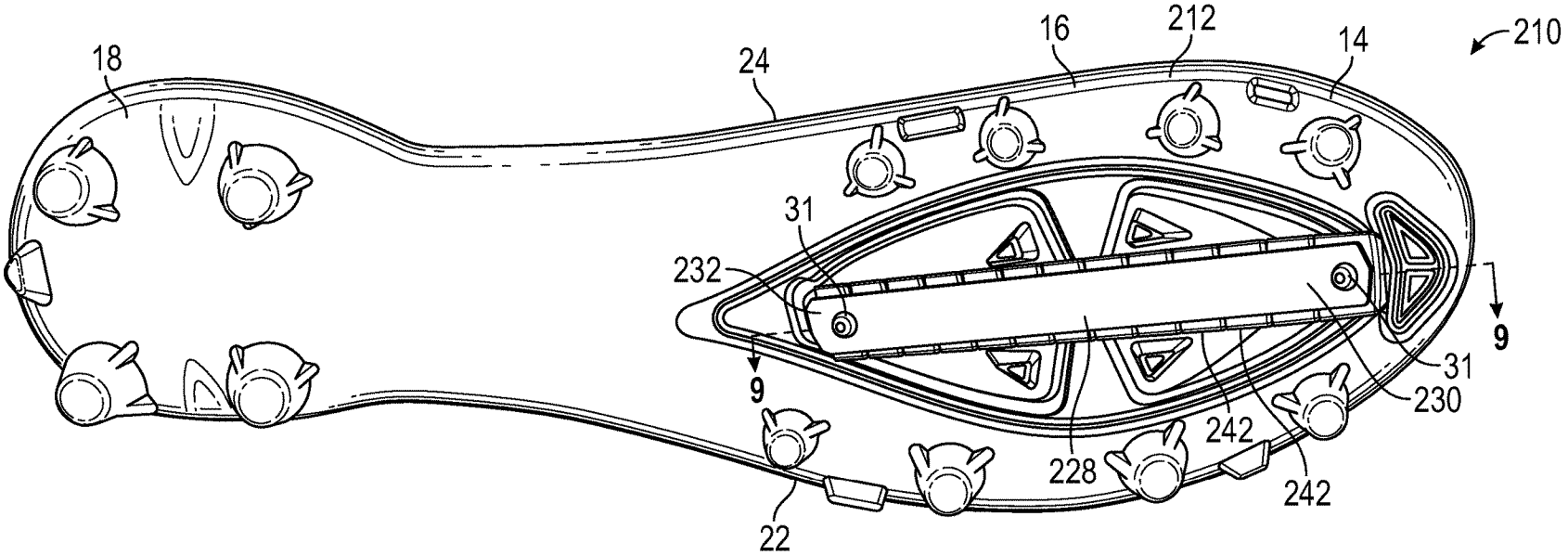
FIG. 8 is a schematic illustration in perspective view showing a ground-facing surface of an alternative embodiment of a sole structure within the scope of the present teachings.
Figure 9:
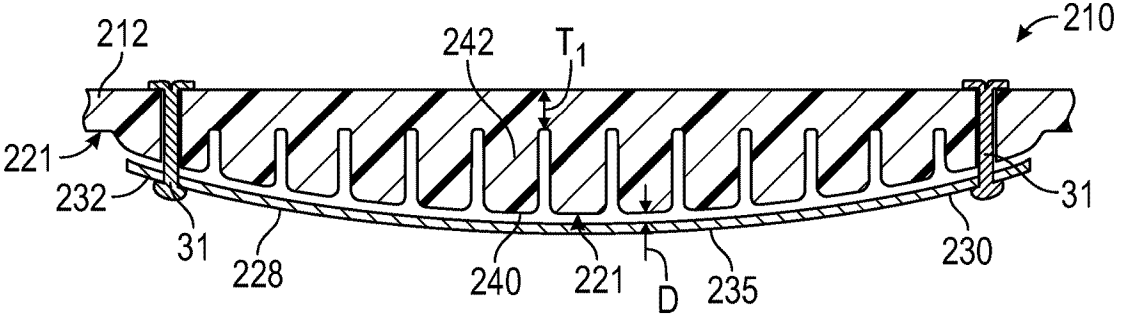
FIG. 9 is a schematic cross-sectional fragmentary illustration of the sole structure of FIG. 8 taken at lines 9-9 in FIG. 8.
Figure 10:
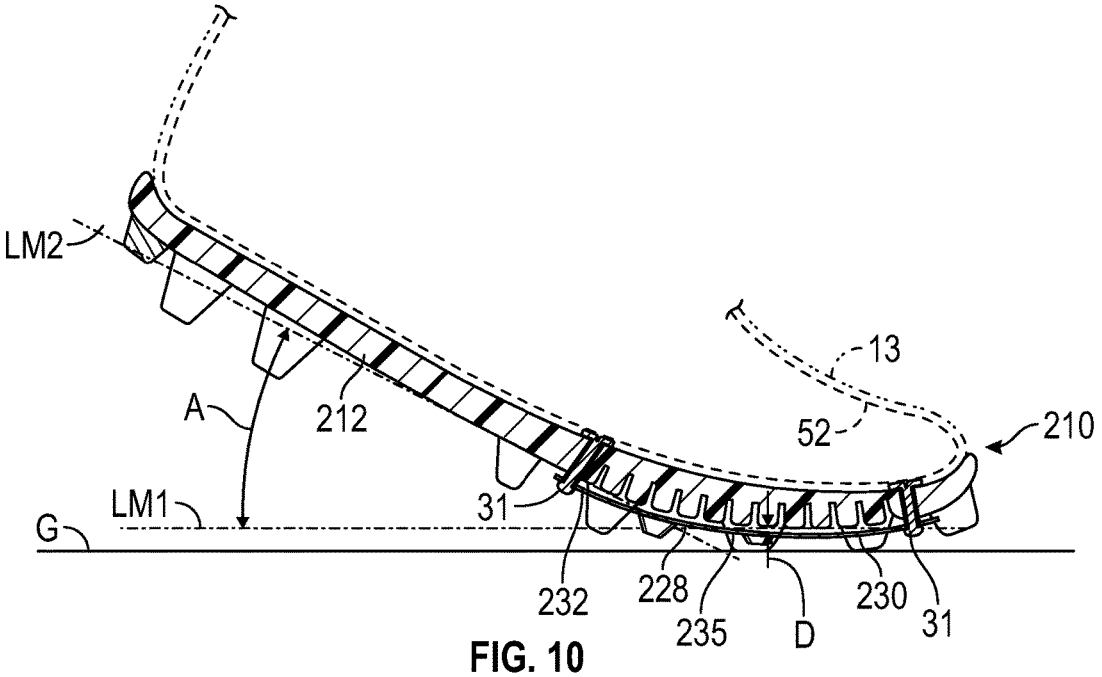
FIG. 10 is a schematic cross-sectional illustration of the sole structure of FIG. 9 flexed in a first portion of a range of flexion.
Figure 11:
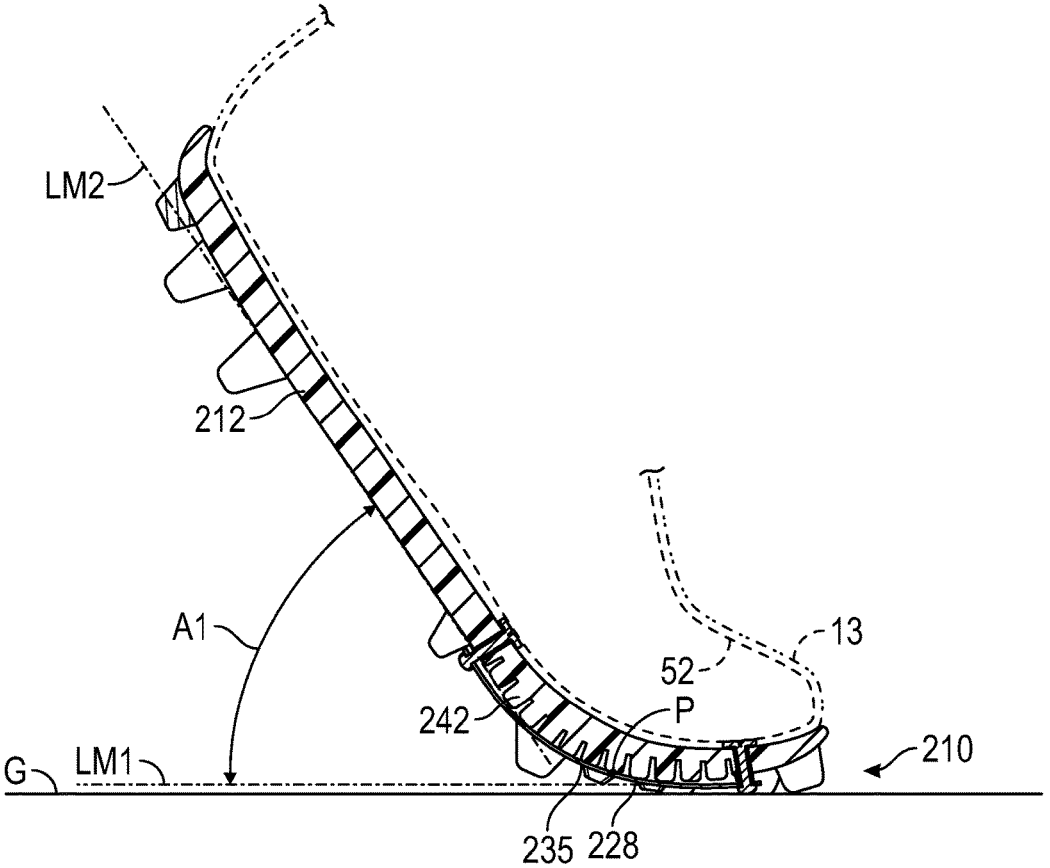
FIG. 11 is a schematic cross-sectional illustration of the sole structure of FIG. 9 flexed at a first predetermined flex angle.

FIGS. 8 and 9 show another embodiment of a sole structure 210 that has a sole plate 212 and a tension member 228 operatively secured to a ground-facing surface 221 of the sole plate 212. Unlike the tension member 28, the tension member 228 is fixed (by rivets 31 or otherwise) at two locations during the entire range of flexion. As shown, the tension member 228 is fixed both at a first portion 230 and a second portion 232 rearward of the first portion 230. The tension member 228 has no slot, and thus does not slide relative to the sole plate 212 in the first portion of the flexion range FR1 in the manner of the tension member 28. However, the tension member 228 has a midportion 235 that is separated from the ground-facing surface 221 of the sole plate 212 by a vertical gap D in the first portion of the flexion range FR1. The midportion 235 is separated from the distal ends 240 of the protrusions 242 in the first portion of the flexion range FR1 by the gap D. In other words, the midportion 235 is suspended below the sole plate 212 between the fixed portions 230, 232, without contact with the sole plate 212. During the first portion of the flexion range FR1, the midportion 235 moves relative to the sole plate 212. The midportion 235 moves upward toward the distal ends 240 as the distal ends 240 likewise move downward toward the tension member 28, decreasing the vertical gap D. At the first predetermined flex angle A1, the midportion 235 contacts the distal ends 240, thereby interfering with the sole plate 212. The contact begins at some point P, indicated in FIG. 11, and spreads forward and rearward as the flexion angle increases. Therefore, as the sole structure 210 bends further, longitudinally opposing forces directed inwardly upon the sole plate 212 can no longer be relieved by the sole plate 212, and particularly the protrusions 242, bending outwardly toward the tension member 228 as they were throughout the first portion of the flexion range FR1. Likewise, longitudinally opposing forces pulling outwardly upon the tension member 228 can no longer be relieved by the tension member 228 straightening and drawing inwardly toward the protrusions 242 as they were throughout the first portion of the flexion range FR1. Instead, further bending of the sole structure 212 is additionally constrained by the tension member's 228 resistance to elongation in response to the progressively increasing tensile forces applied along its length, and by the sole plate's 212 resistance to compressive shortening and deformation in response to the compressive forces applied along its longitudinal axis. Accordingly, the tensile and compressive characteristics of the material(s) of the tension member 228 and sole plate 212 (including the protrusions 242), respectively, play a large role in determining a change in bending stiffness of the sole structure 212 as it transitions from the first portion of the flexion range FR1, to and through the second portion of the flexion range FR2.

Figure 12:
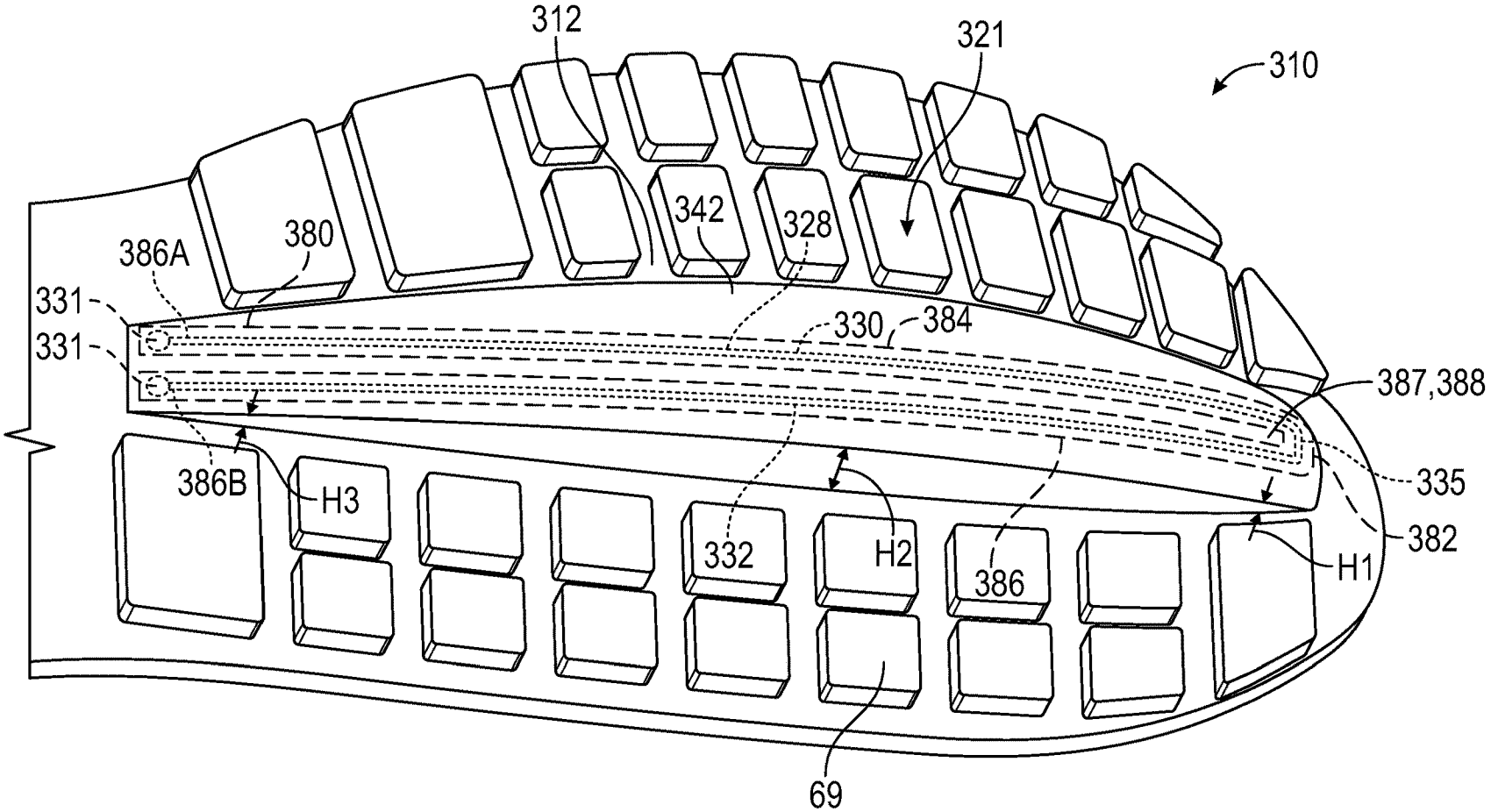
FIG. 12 is a schematic illustration in fragmentary perspective view showing a ground-facing surface of an alternative embodiment of a sole structure within the scope of the present teachings.

FIG. 12 is a schematic illustration in perspective view of an alternative embodiment of a sole structure 310 within the scope of the present teachings. The sole structure 310 has a sole plate 312 with a ground-facing surface 321. The sole plate 312 has a protrusion 342 at the ground-facing surface 321. The protrusion 342 is a single continuous protrusion with a generally bowed profile, having a greater height H2 in a middle of the protrusion 342 than a height H1 at a forward portion and a height H3 at rearward portion. Accordingly, the protrusion 342 has a bowed profile even when the sole plate 312 is in the unflexed, relaxed state of FIG. 12. Alternatively, the protrusion 342 could be a series of protrusions such as protrusions 42.

The protrusion 342 has an enclosed channel 380. The enclosed channel 380 generally has an elongated U shape (i.e., the channel 380 is U-shaped), with a forward branch 382 extending generally transversely, and first and second arm branches 384, 386, respectively, spaced from one another and extending in a common direction (i.e., generally in a longitudinal rearward direction) from the forward branch 382. A tension member 328 is disposed in the channel 380. A midportion 335 of the tension member 328 is disposed in the forward branch 382, and first and second arm portions 330, 332 of the tension member 328 both extend generally rearward in the longitudinal direction from the midportion 335, with the first arm portion 330 disposed in the first arm branch 384, and the second arm portion 332 disposed in the second arm branch 386. The tension member 328 is restrained by the body of protrusion 342 at a first location 388, namely the portion of the protrusion 342 between the branches 384, 386. First and second ends 386A, 386B of the tension member are restrained at a second location rearward of the first location by rivets 331 or otherwise. The ends 386A, 386B of the tension member 328 may be fixed by the rivets 331. In that case, the length of the tension member 328 may be selected so that there is some slack in the arm portions 330, 332 when the sole structure is in the relaxed, unflexed state shown in FIG. 12. Alternatively, instead of rivets, the ends 386A, 386B may be enlarged relative to the width of the channel 380 and may be rearward of ends of the channel 380. Alternatively, the tension member 328 may be arranged as a continuous loop with a portion extending transversely at the second location to connect the first and second arm portions 330, 332. In that case, the channel 380 would also have a transversely extending rearward branch that connects the first and second arm branches 384, 386.

A cross-section of the channel 380 perpendicular to its length along one of the arm portions 330, 332 may be generally circular. The tension member 328 may be a cable with a generally circular cross-section. The tension member 328 is longer than the channel 380 so that some slack is afforded in the tension member 328 in the relaxed state of the sole structure 310. The slack allows the tension member 328 to initially move relative to the sole plate 312 as the slack in the tension member 328 is taken up during dorsiflexion in a first portion of the flexion range FR1. Bending stiffness of the sole structure 310 in the first portion of the flexion range FR1 thus generally corresponds with the bending stiffness of the sole plate 312. At the first predetermined flex angle A1, the tension member 328 is no longer slack, and dorsiflexion of the forefoot portion 14 causes the midportion 335 to interfere with the body 387 of the protrusion 342 at the first location 388. Accordingly, tension occurs in the tension member 328, with outwardly opposing tensile forces acting on the midportion 335 (due to the body 387) and at the ends 386A, 386B. Bending stiffness of the sole structure 310 in the second portion of the flexion range FR2 is further affected by compression of the sole plate 312 as well as tension of the tension member 328. The sole structure 310 thus provides an increased bending stiffness in the second portion of the flexion range FR2 relative to the first range of flexion FR1 resulting in a non-linear bending stiffness.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. A sole structure for an article of footwear comprising:

a sole plate that includes:

a forefoot portion with a foot-facing surface; and a ground-facing surface opposite from the foot-facing surface; and a tension member operatively secured to the ground-facing surface and having a portion that has a slot and that is configured to:

move relative to the sole plate during dorsiflexion of the sole structure in a first portion of a flexion range; and interfere with the sole plate during dorsiflexion of the sole structure in a second portion of the flexion range greater than the first portion;

a post extending at the ground-facing surface of the sole plate and disposed in the slot; and wherein the slot moves relative to the sole plate during the first portion of the flexion range and the post abuts the tension member at an end of the slot in the second portion of the flexion range.

2. The sole structure of claim 1, wherein:

the first portion of the flexion range includes flex angles of the sole plate less than a first predetermined flex angle;

the second portion of the sole plate includes flex angles greater than or equal to the first predetermined flex angle; and the sole structure has a change in bending stiffness at the first predetermined flex angle.

3. The sole structure of claim 1, wherein the sole structure provides a first bending stiffness in the first portion of the flexion range, and provides a second bending stiffness greater than the first bending stiffness in the second portion of the flexion range.

4. The sole structure of claim 1, wherein the tension member is configured to be relatively slack when the portion moves relative to the sole plate in the first portion of the flexion range and in tension when the sole plate interferes with the portion in the second portion of the flexion range.

5. The sole structure of claim 1, wherein only a forward portion of the tension member is fixed to the sole plate, and the portion that moves relative to the sole plate in the first portion of the flexion range is a rearward portion of the tension member.

6. The sole structure of claim 1, further comprising:

at least one protrusion at the ground-facing surface; and wherein the tension member extends across the at least one protrusion such that at least a portion of the tension member is displaced from the foot-facing surface by at least a portion of the protrusion.

7. The sole structure of claim 6, wherein the at least one protrusion is a series of protrusions with gaps between adjacent ones of the protrusions.

8. The sole structure of claim 7, wherein the protrusions vary in height and the series of protrusions has a bowed profile.

9. The sole structure of claim 7, wherein the tension member confronts distal ends of the protrusions and slides along the distal ends during the first portion of the flexion range.

10. The sole structure of claim 1, wherein:

the tension member is a relatively flat strap having a thickness, a width greater than the thickness, and a length greater than the width; and the tension member is disposed lengthwise along a longitudinal midline of the sole plate.

11. The sole structure of claim 10, wherein the strap is metal, a polymeric material, a composite, or fabric.

12. The sole structure of claim 1, wherein the sole plate is an inner board plate, an outsole plate, a midsole plate, or a unisole plate.

13. A sole structure for an article of footwear comprising:

a sole plate that includes:

a foot-facing surface; and a ground-facing surface opposite from the foot-facing surface;

a post extending from the ground-facing surface;

a strap having a slot; wherein:

a forward portion of the strap is fixed to a forefoot portion of the sole plate at the ground-facing surface;

the post is disposed in the slot rearward of the forward portion;

the strap slides relative to the sole plate during dorsiflexion of the sole structure in a first portion of a flexion range;

the post abuts the strap at an end of the slot in a second portion of the flexion range that includes flex angles greater than in the first portion of the flexion range; and the strap is in greater tension in the second portion of the flexion range than in the first portion of the flexion range.

14. The sole structure of claim 13, wherein:

the first portion of the flexion range includes flex angles of the sole plate less than a first predetermined flex angle;

the second portion of the sole plate includes flex angles greater than or equal to the first predetermined flex angle; and the sole structure has a change in bending stiffness at the first predetermined flex angle.

15. The sole structure of claim 13, wherein the sole structure provides a first bending stiffness in the first portion of the flexion range, and provides a second bending stiffness greater than the first bending stiffness in the second portion of the flexion range.

16. The sole structure of claim 13, wherein the strap is configured to be relatively slack when the strap slides relative to the sole plate in the first portion of the flexion range and in tension when the post abuts the strap in the second portion of the flexion range.

17. A sole structure for an article of footwear, the sole structure comprising:

a sole plate that includes:

a foot-facing surface; and a ground-facing surface opposite from the foot-facing surface;

a post extending from the ground-facing surface;

a strap having a slot; wherein:

a forward portion of the strap is fixed to a forefoot portion of the sole plate at the ground-facing surface;

the post is disposed in the slot rearward of the forward portion;

the strap slides relative to the sole plate during dorsiflexion of the sole structure in a first portion of a flexion range;

the post abuts the strap at an end of the slot in a second portion of the flexion range that includes flex angles greater than in the first portion of the flexion range; and the strap is in greater tension in the second portion of the flexion range than in the first portion of the flexion range;

at least one protrusion at the ground-facing surface; and wherein the strap extends across the at least one protrusion such that at least a portion of the strap is displaced from the foot-facing surface by at least a portion of the protrusion.

18. The sole structure of claim 17, wherein the at least one protrusion is a series of protrusions with gaps between adjacent ones of the protrusions.

19. The sole structure of claim 18, wherein the protrusions vary in height and the series of protrusions has a bowed profile.

20. The sole structure of claim 18, wherein the strap confronts distal ends of the protrusions and slides along the distal ends during the first portion of the flexion range.

21. The sole structure of claim 18, wherein the foot-facing surface has recesses corresponding with the protrusions.

22. The sole structure of claim 13, wherein:

the strap has a thickness, a width greater than the thickness, and a length greater than the width; and the strap is disposed lengthwise along a longitudinal midline of the sole plate.

23. The sole structure of claim 22, wherein the strap is metal, a polymeric material, a composite, or fabric.

* * * * *